US007086791B2

(12) United States Patent
Hall et al.

(10) Patent No.: US 7,086,791 B2
(45) Date of Patent: Aug. 8, 2006

(54) MECHANICAL INTERFACE USING SINGLE STROKE OPENER FOR MULTI-CONTAINER CHEMICAL CARTRIDGE

(75) Inventors: Jeffrey L. Hall, Rochester, NY (US); Craig S. LeFevre, Honeoye Falls, NY (US); Ralph L. Piccinino, Jr., Rush, NY (US); Kevin H. Blakely, Rochester, NY (US); Stacy N. Burris, Rochester, NY (US); Eduard Kaminker, Rochester, NY (US)

(73) Assignee: Eastern Kodak Company, Rochester, NY (US)

( * ) Notice: Subject to any disclaimer, the term of this patent is extended or adjusted under 35 U.S.C. 154(b) by 68 days.

(21) Appl. No.: 10/988,654

(22) Filed: Nov. 15, 2004

(65) Prior Publication Data

US 2006/0104634 A1 May 18, 2006

(51) Int. Cl.
*G03D 3/08* (2006.01)

(52) U.S. Cl. ..... 396/626; 206/255

(58) Field of Classification Search ..... None
See application file for complete search history.

(56) References Cited

U.S. PATENT DOCUMENTS 4,271,965 A * 6/1981 Brambley et al. ..... 206/219
4,533,225 A * 8/1985 Shiga ..... 396/622
5,151,731 A 9/1992 Yamada et al.
5,488,447 A 1/1996 Patton et al.
5,694,991 A 12/1997 Harris et al.
6,520,693 B1 2/2003 Lobo et al.
6,579,669 B1 6/2003 Schmittou et al.

OTHER PUBLICATIONS

Research Disclosure, Apr. 1998, No. 408110, Method of Supplying Processing Liquid to a Photographic Processing Machine and Removing Waste Liquid Therefrom, pp. 425-428.
Research Disclosure, Dec. 1978, No. 17643, Photographic Silver Halide Emulsions, Preparations, Addenda, Processing and Systems.
Research Disclosure, Dec. 1989, No. 308119, Photographic Silver Halide Emulsions, Preparations, Addenda, Processing and Systems, pp. 993-1015.
Research Disclosure, Sep. 1996, No. 38957, Photographic Silver Halide Emulsions, Preparations, Addenda, Systems and Processing, pp. 591-639.

* cited by examiner

*Primary Examiner*—D. Rutledge
(74) *Attorney, Agent, or Firm*—David A. Novais

(57) ABSTRACT

A waste container is received in a photographic processing machine along with a chemical supply container. The supply container is oriented at an angle to horizontal. Ports are provided into the containers with an associated snap cap oriented such that the neck extends vertically when received in the processing machine. A shipping cassette system includes two stacked upper and lower cassettes, each having a plurality of vertical walls that laterally surround an interior volume. A processing machine includes a cap opening bar and a mounting mechanism with a pivot point aligning the bar with the caps of a chemical delivery container assembly along a side of the caps opposite to the side along which the hinges are aligned such that rotation of the cap opening bar about the pivot point simultaneously opens the fluid supply ports by rotating the caps about their hinges.

22 Claims, 15 Drawing Sheets

MECHANICAL INTERFACE USING SINGLE STROKE OPENER FOR MULTI-CONTAINER CHEMICAL CARTRIDGE

FIELD OF THE INVENTION

The present invention relates to the general field of color photographic processing, and more particularly to chemical delivery devices for such processing.

BACKGROUND OF THE INVENTION

Color photographic processing typically includes the processing steps of development, bleaching, fixing, washing, and/or stabilizing. For color negative materials these steps are practiced using a color developer that generates the dye image and, as a side product, metallic silver; a bleach containing a heavy metal bleaching agent that converts any metallic silver into silver ion; and a fixing solution containing a fixing agent that forms soluble silver ion complexes which are removed in the fixing and subsequent washing or stabilizing steps. Finally, the photographic element may be processed in a stabilization step that renders the material stable for storage and includes agents, such as surfactants, that allow water to sheet off the surface without streaking. Representative sequences for processing various color photographic materials are described, for example, in *Research Disclosure* publication 308119, December 1989; publication 17643, December 1978; and publication 38957, September 1996. Silver halide photographic elements that are processed include color negative photographic films, color reversal photographic films, and color photographic papers. The general sequence of steps and conditions (times and temperatures) for processing are well known as Process C-41 and Process ECN-2 for color negative films, Process E-6 and Process K-14 for color reversal films, Process ECP for color prints, and Process RA-4 for color papers.

With the move to digital or hybrid technologies, the current trend is to provide processing sequences that are more rapid than achieved with these trade standard processes. Additionally, it is becoming increasingly undesirable in the photo finishing trade to manage photographic chemistries and their associated effluents, including managing effluents to on-site drains and local sewer systems. Chemical solutions are now often supplied in concentrated form that are diluted on the processing machine or are used directly at low replenishment rates to reconstitute the processing solutions as they are used such as described by Eastman Kodak Co. in U.S. Pat. No. 5,488,447 and U.S. Pat. No. 5,694,991 or in U.S. Pat. No. 5,151,731. These solutions are often delivered in rigid, single use containers. The machine interface to accept these containers often requires that these containers be inverted to empty with the resultant potential to leak. When supplying the solutions to the processing machine, to reduce the potential to leak, it is advantageous to have these containers mounted on the machine in an upright fashion. Additionally, it is desirable to reuse these containers for both economic and environmental reasons.

Some recent trends focus on use of flexible containers, mounted either in inverted or upright positions on a processing machine. However, flexible bags can potentially be ruptured during shipment resulting in a leaking container. This potential to rupture is recognized by the Department of Transportation, which requires additional testing to verify that the flexible bag remains leak proof if it is to be reused.

Photo processing container reuse has been described in *Research Disclosure* publication 408110. This disclosure recites the reuse of the chemical supply containers. The disclosure indicates that each functional solution is separately supplied along with a corresponding waste container for that processing solution. When solutions are independently supplied to a photo finishing machine, the operator must insure that each fresh supply solution is properly connected to the machine. The risk of incorrectly connecting the supply solution to the appropriate processing machine interface is increased. Failure to correctly connect these solutions can be catastrophic, resulting in the loss of customer orders.

Additionally, it is becoming more desirable to develop convenient and cost-effective mechanisms to collect photographic effluents in containers for shipment off site. Photo processing effluent that is characterized as corrosive (as defined by U.S. waste management regulations) cannot be managed on-site for disposal. Further, waste mixtures that are corrosive may not be transported off site without adhering to stringent government regulatory requirements that may include special labeling and handling procedures. In addition, licensed haulers must be used to manage corrosive wastes off site, presenting an additional cost burden to the photofinisher. Therefore, it is advantageous in handling, transporting, and disposing of photographic effluents and their containers for the effluents not to be corrosive (as defined by government waste management regulations) as described in U.S. Pat. No. 6,579,669 and references cited therein. The combination of the processing waste from each functional solution into a single effluent container helps manage the corrosivity of the waste effluent. Reusability of the effluent containers is important as described in U.S. Pat. No. 6,520,693. However, connecting an independent effluent waste container to the processing machine increases the complexity of the machine because an additional monitoring system is required to insure that this container is replaced when the waste container is full. If the independent waste container is not replaced when the supply chemistry is replaced, it is possible for the waste effluent to overflow the container. To avoid such overflow problems, the art often uses sensors or other signaling means to alert the operator to change or empty the waste container.

Government regulations often specify the maximum residual volume that can be left in a container before that container is considered empty. If this maximum residual volume is exceeded and the container held solutions considered to be hazardous waste, then the container must be treated as the same. Therefore it is critical that the containers used to deliver such solutions are emptied to levels equal to or less than that specified by governmental regulations in order that the containers are considered to be empty.

Continuous contact of the processing solution between the solution supply and the processing tank is important for effective operation of the processor. Specifically, air entrainment in the solution delivery line can cause errors in the calculated solution flow to the processing tank, which can then affect processing performance as well as bottle emptying. It is known in the trade that air can degrade the activity of the developer. Yet there is a need to effectively empty the upright containers of their delivered solution in order to meet regulatory demands. Additionally, effective solution removal as defined by government regulation is required for rigid upright containers that must simultaneously empty in order that one cartridge containing multiple rigid bottles can be removed from the processing machine and treated as non-hazardous waste.

SUMMARY OF THE INVENTION

Unitized rigid containers in an upright position also provide easy access to interface with a processing unit's delivery system. Specifically, the rigid containers are connected to the processing unit in such a way that the necks of the containers are positioned at the top, in an upright position and all at the same height above the containers. This will allow one single stroke mechanical drive system to be used to interface the replenishment lines with each of the containers.

The fitment that provides closure for the containers as well as the interface for the replenishment lines also requires orientation along the horizontal plane to properly interface with the replenishment lines. The linear alignment of the necks of the unitized rigid containers allows for a simple, single stroke mechanical interfacing with the processing machine. Flip caps, common in the trade for such items as ketchup bottles, can be attached to the unitized rigid containers as simple fitments. A single bar mechanism can effectively open all of the unitized rigid containers at once.

The rigid container necks are vertical relative to the machine interface. Therefore the rigid containers are molded with a slight pitch to the neck so that when the rigid containers are tipped to insure emptying the necks are then vertical.

The fluid connection of the processing machine to the specific processing solution supplied by the unitized rigid containers is accomplished using a set of solution delivery probes referred to as tubes. One probe is used for each processing solution and one for waste solution accumulation. These probes are themselves attached to a single drive mechanism that then inserts the probes into the opened unitized rigid container.

According to a feature of the present invention, a rigid waste container is adapted to be received in a photographic processing machine along with a chemical supply container. The waste container includes a wall structure enclosing a volume, and the wall structure includes a major top surface adapted to receive at least one chemical supply container. The wall structure is formed at an angle to horizontal when the waste container is received in the processing machine, wherein a surface of a received chemical supply container engaging the major top surface of the waste container is oriented at an angle to horizontal. A port is provided into the volume through which waste chemical is receivable from the process machine. In a preferred embodiment, the major top surface of the waste container is a depression in the wall structure. Also, the major top surface of the waste container may be a plurality of depressions in the wall structure, each depression being adapted to receive a respective chemical supply container. The port may comprise a necked region and an associated cap, which may be snap fitted to the necked region. The port may be necked and oriented such that the neck extends vertically when the waste container is received in the processing machine.

According to another feature of the present invention, a rigid container assembly for use with a photographic processing machine includes a rigid waste container adapted to be received in the processing machine at a predetermined orientation. The waste container has a major top surface formed at an angle to horizontal when the waste container is received in the processing machine. At least one rigid supply container for chemical delivery to the processing machine is provided and has a bottom wall that forms a bottom surface of a fluid chamber in the container. The bottom wall fits the top surface of the waste container such that the bottom surface of the fluid chamber is tipped so that fluid in the chamber flows to a low side of the chamber. The contouring of the waste container also provides a means to key the supply bottle so that the supply container is always correctly matched to the fluid distribution system of the processing machine. A fluid supply port is located in a top wall of the supply container above the low side. Preferably, the major top surface of the waste container is a depression. The waste container further has a necked fluid waste receiving port, an associated cap, and a waste drain. The fluid supply port is preferably necked and oriented such that the neck extends vertically when the waste container and the supply container are received in the processing machine.

According to yet another feature of the present invention, a shipping and chemical delivery cassette for a container of photographic processing chemical includes a plurality of vertical walls that substantially laterally surround an interior volume, a bottom wall sloping from first side of the cassette toward a second, opposed side of the cassette, and a plurality of ribs extending upwardly from the bottom wall and terminating in a common horizontal plane so as to form a plurality of open topped cavities between the ribs.

According to still another feature of the present invention, a shipping and chemical delivery cassette system for containers of photographic processing chemical includes two stacked upper and lower delivery cassettes, each having a plurality of vertical walls that laterally surround an interior volume. A bottom wall slopes from first side of the cassette toward a second side of the cassette. The first and second sides are opposed to each other, and a plurality of ribs extend upwardly from the bottom wall and terminate in a common horizontal plane so as to form a plurality of open-topped cavities between the ribs. A single container in the lower cassette conforms approximately to the interior volume surrounded by the vertical walls so as to rest on the ribs in the common horizontal plane. The containers in the upper cassette are substantially smaller than the single container so as to fit between respective upwardly extending ribs into the open-topped cavities.

According to but another feature of the present invention, a photographic processing machine includes a housing adapted to receive a chemical delivery container assembly having a plurality of aligned fluid supply ports with associated caps having aligned hinges along one side of the caps. The processing machine includes a cap opening bar and a mounting mechanism with a pivot point aligning the cap opening bar with the caps of a received chemical delivery container assembly along a side of the caps opposite to the one side along which the hinges are aligned such that rotation of the cap opening bar about the pivot point simultaneously opens the fluid supply ports by rotating the caps about their hinges.

DETAILED DESCRIPTION OF THE INVENTION

Figure 1:
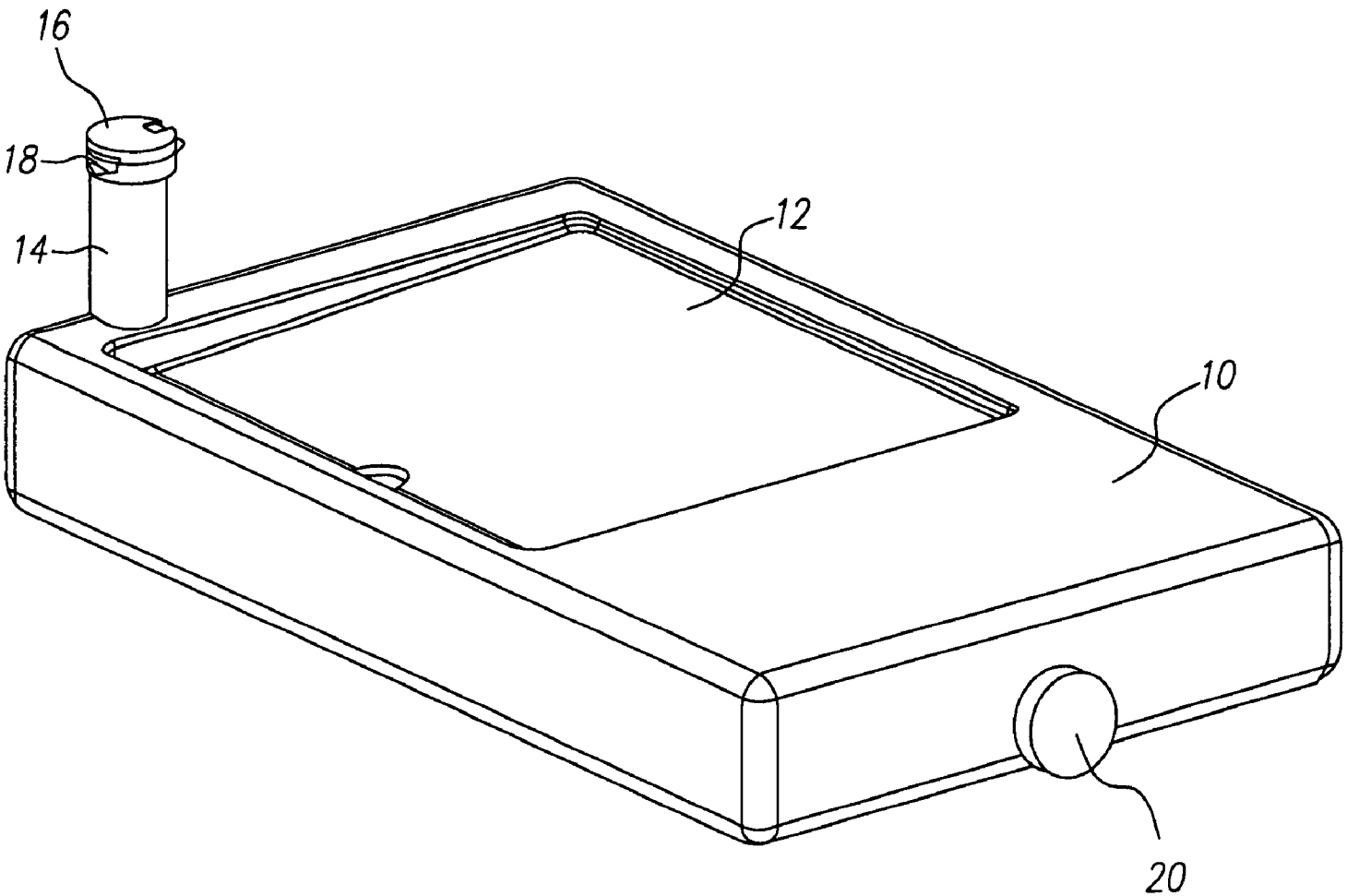
FIG. 1 is a perspective view of a rigid contoured waste container.

FIG. 1 is a perspective view of a rigid contoured waste container 10. The waste container has a tapered recess 12 and a long necked waste solution receiving port 14. Port 14 has a cap 16 with a tab 18. Additionally, waste container 14 is fitted with a waste container drain 20 to facilitate emptying.

Figure 2:
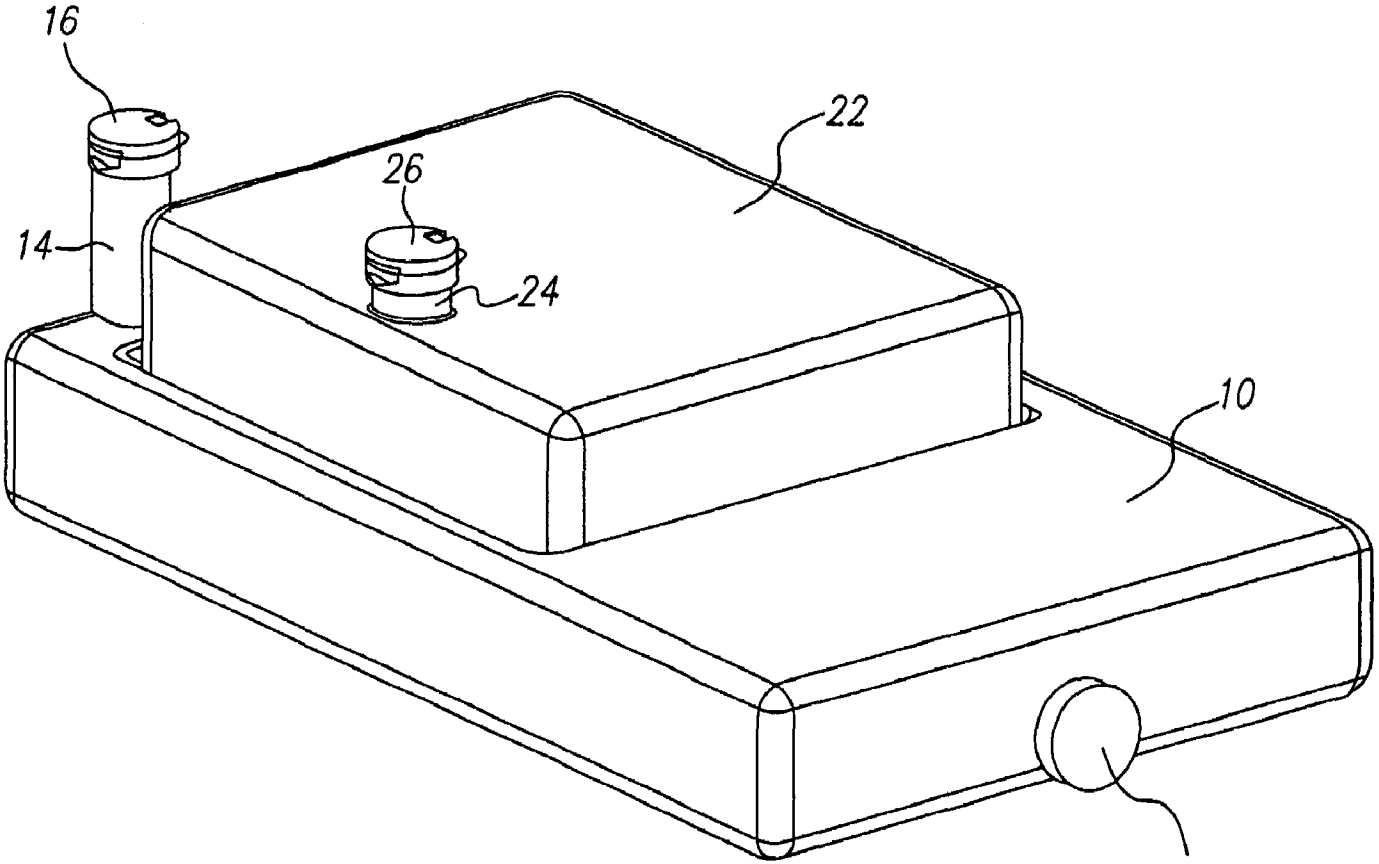
FIG. 2 is a perspective view of a rigid supply container which on top of the rigid contoured waste container of FIG. 1.
Figure 3:
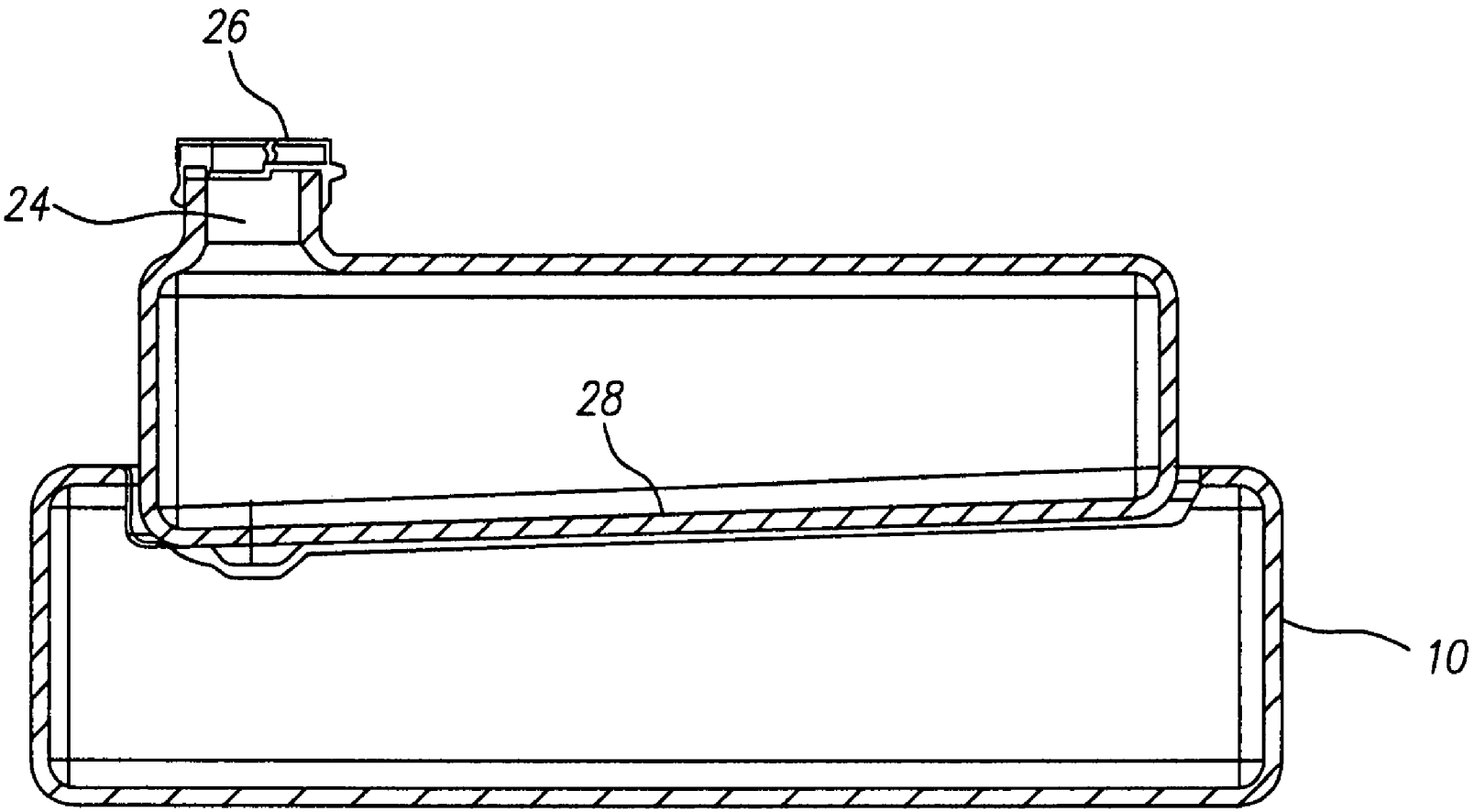
FIG. 3 is a side sectional view taken through the supply and waste containers of FIG. 2.

Referring to FIGS. 2 and 3, a rigid supply container 22, which is used for chemical delivery, sits on top of rigid contoured waste container 10, and has its own port 24 and associated cap 26. The bottom wall 28 of supply container 22 is slanted to fit within tapered recess 12 of waste container 10 such that ports 14 and 24 are aligned and so that bottom wall 28 is sloped to a deepest region directly below port 24. In so doing, a tube through port 24 can be inserted to the deepest region of container 22 so that the contents can be almost entirely emptied through the tube to the level required by the Federal Government.

Figure 4:
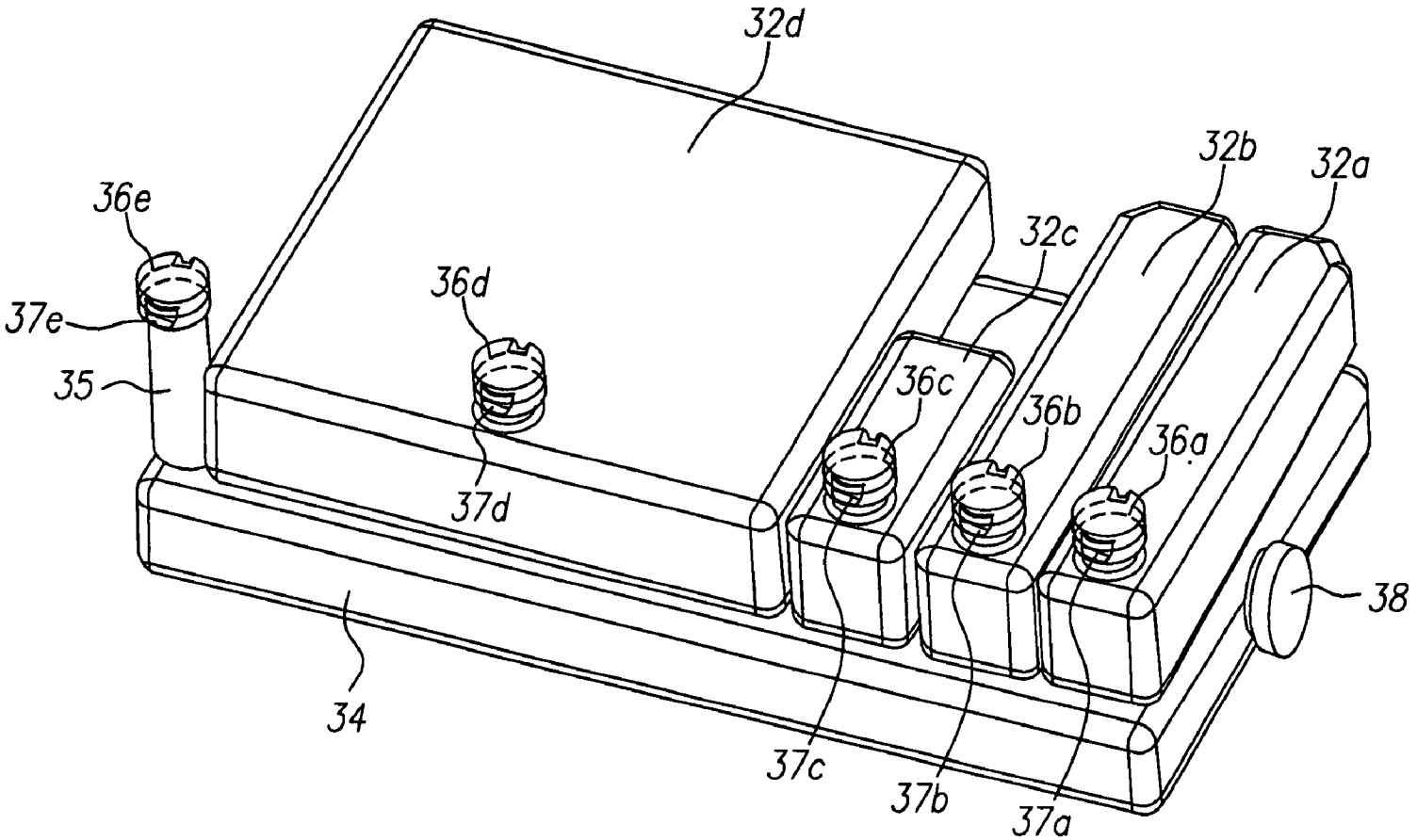
FIG. 4 is a perspective view of a rigid contoured waste container and a plurality of rigid supply containers according to another embodiment of the present invention.

FIG. 4 is a perspective view of a rigid container assembly 10 according to another embodiment of the present invention. Four rigid supply containers 32*a*–32*d*, which are used for chemical delivery, sit on top of a rigid contoured waste container 34. The waste container has a long necked waste solution receiving port 35 which, along with ports on supply containers 32*a*–32*d*, have associated caps 36*a*–36*e* and associated tabs 37*a*–37*e*, illustrated in a closed position in FIG. 4. Additionally, waste container 34 is fitted with a waste container drain 38 to facilitate emptying.

As with the embodiment of FIGS. 1–3, supply containers 32*a*–32*d* of FIG. 4 sit in tapered recesses on the top of waste container 34 such that ports 36*a*–36*d* are aligned and so that bottom wall of the supply containers are sloped to a deepest region directly below the ports. A cross section taken through supply container 32*d* and waste container 34 would look similar to FIG. 3.

Figure 5:
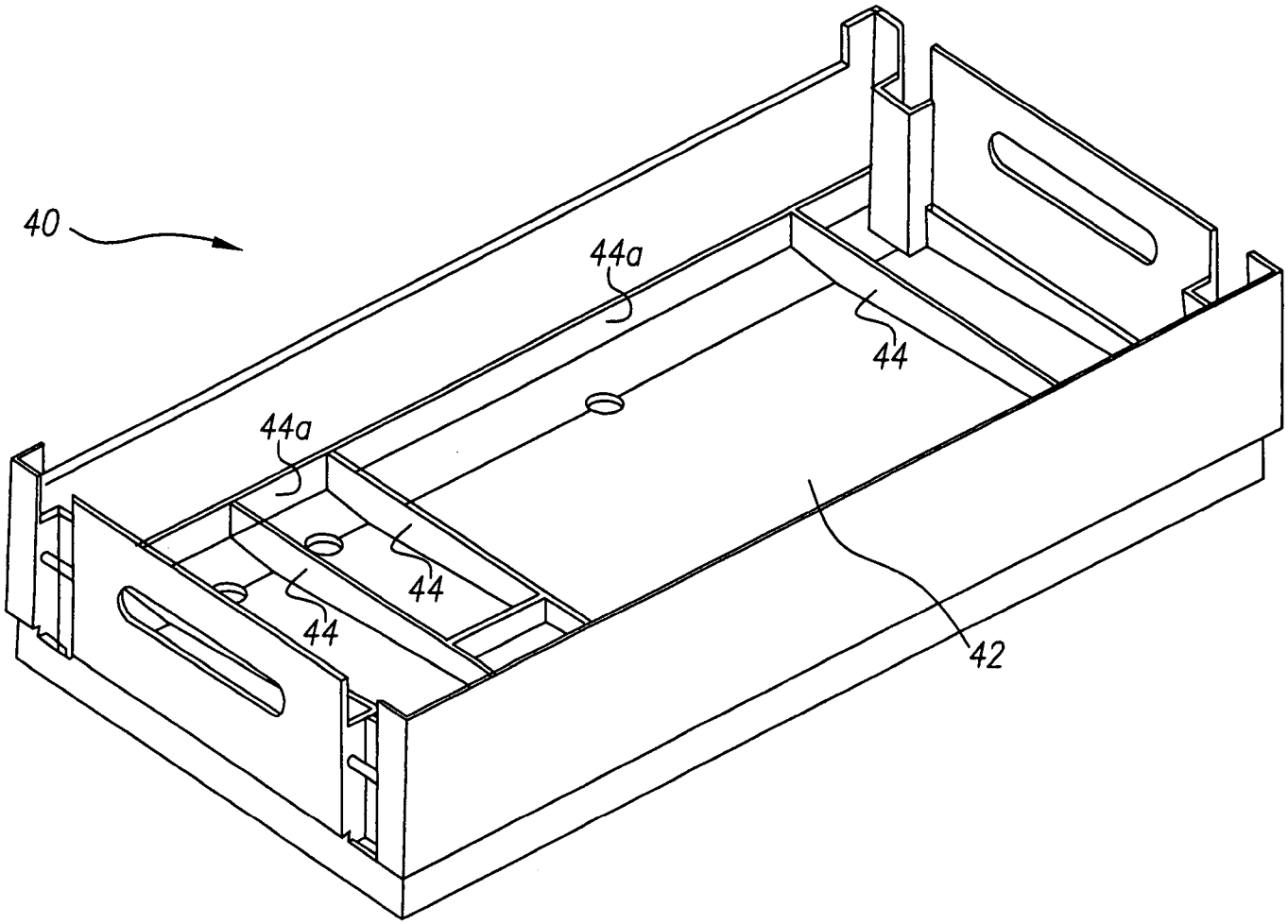
FIG. 5 is a detail view of a shipping and chemical delivery cassette for use with the waste and supply containers of FIGS. 1–4.

FIG. 5 is a detail view of a shipping and chemical delivery cassette 40 usable with embodiments shown in FIGS. 1–4. The cassette consists of a main body and a plurality of ribs 44 extending upwardly from the bottom.

FIG. 5 also shows the tops of the ribs 44 in the same horizontal plane. Therefore, a flat-bottomed waste container as shown in FIG. 3 when placed on top of these ribs would be in a horizontal plane.

There are multiple ways to tip the supply containers based on this configuration. In one embodiment, the contoured top of the waste container has tipped recesses to accept the rigid supply bottles thus tipping them as shown in FIG. 1 and FIG. 3. That is, the ribs 44 do not impact the tipping. This integral packaging uses one cassette 40.

Figure 6:
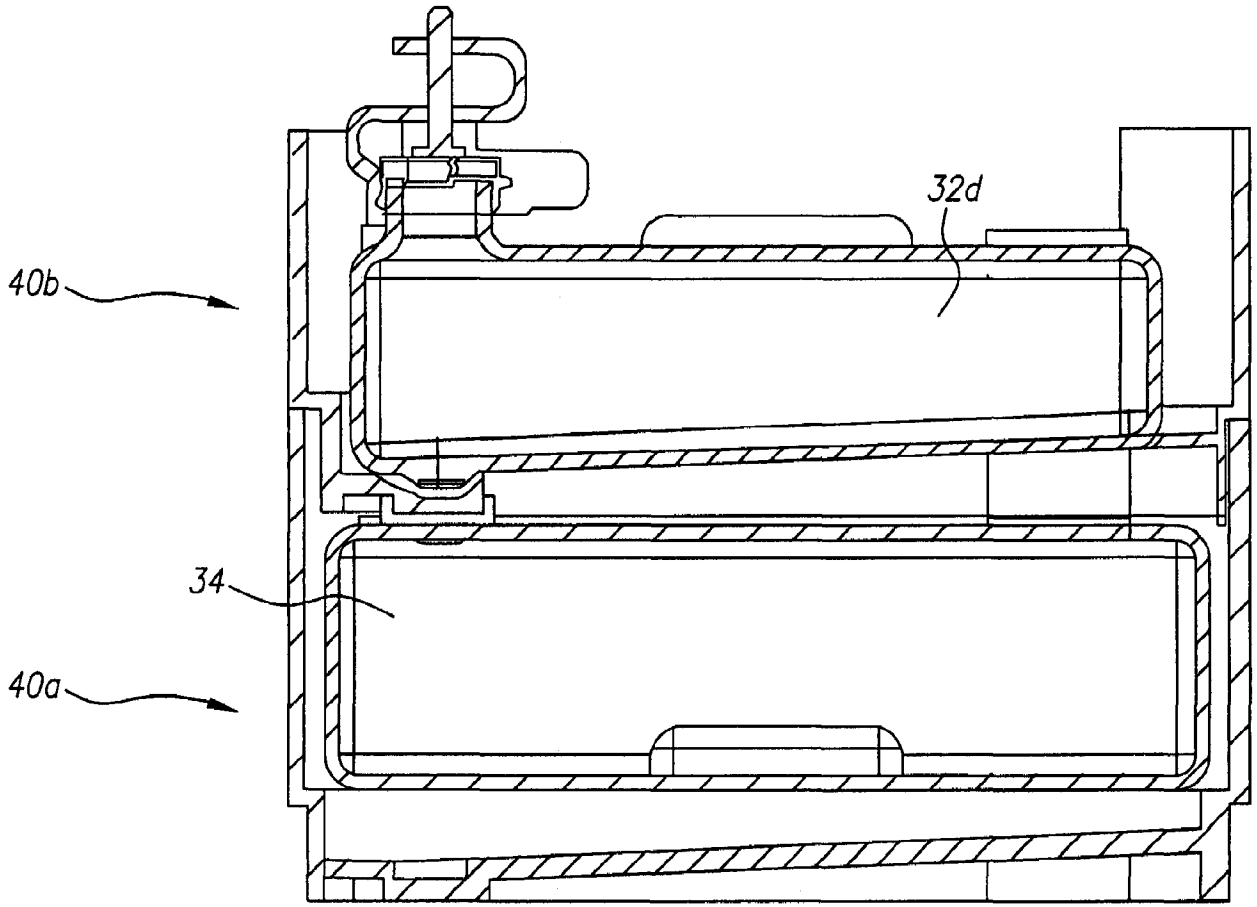
FIG. 6 is a section view of a shipping and chemical delivery cassettes loaded with supply and waste cassettes.

In a second embodiment, two cassettes are used. The second cassette 40*b* is placed over the waste container in the lower cassette 40*a*. The neck of the waste container must protrude through this upper cassette 40*b* (FIG. 6). Referring to FIG. 5, one can see that the bottom of the ribs 44 have a common side 44*a* that is taller than the opposing common side (not shown) therefore, if the top of the ribs are in the same plane, then the bottom of cassette 40*b* is not flat, i.e. the bottom is not in a plane parallel to the top of the ribs. Again, the ribs 44 do not impact the tipping but rather form cavities to receive the shaped rigid supply containers. In this approach, the waste container sits in the lower cassette and is kept flat by the tops of the ribs. Now the shaped supply containers sit in the cavities defined by the ribs as shown in FIG. 6.

In a third embodiment, a single cassette 40 is used in which the top of the ribs 44 are not parallel to the floor of the cassette 40, that is they have a common side (for example 44*a*) that is higher than the opposing common side. In this configuration, a flat-bottomed waste container sits on top of the canted ribs 44 and is thereby tipped to one side. Supply containers sit in flat, keyed recesses in the top of waste container. The necks of the waste container and the supply containers must be perpendicular to the floor of the cassette to properly interface with the single stroke opener for the multi-container cartridge. To allow for simultaneous automatic opening of caps 36*a* through 36*e*, each neck must be slightly canted relative to the top of the rigid container by approximately the same degree that the containers are tipped to insure that the container tops are all in the same vertical plane relative to the machine. The advantage of this configuration is that the bottoms of the container are flat.

This tipping of the rigid supply containers in any of these three embodiments insures that they can be emptied during use, to the level required by the Federal Government. That is, there is a need met by this invention for the integrated design of the containers and the machine interface to provide for automatic simultaneous opening of the rigid containers, leak proof integration of the supply and waste containers with the machine without operator intervention, efficient emptying of the rigid supply containers to meet Federal regulations, as well as effective design for recycling and reuse of the components.

Figure 7:
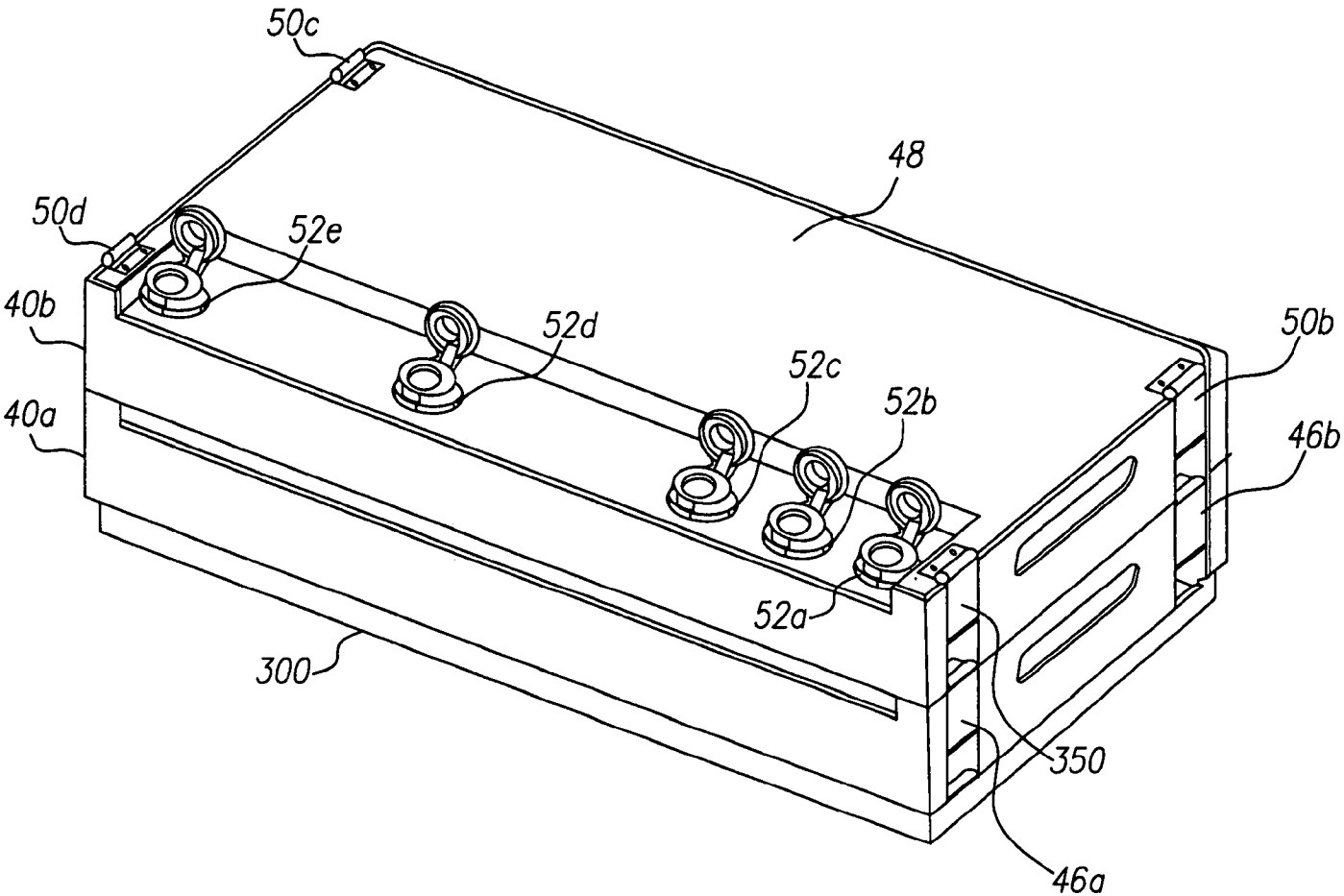
FIG. 7 is a detail view of a shipping and chemical delivery cassette loaded with the rigid container assembly of FIGS. 1 and 2.

FIG. 7 is a detail view of a stack of two shipping and chemical delivery cassettes 40*a* and 40*b*, respectively, as depicted in FIG. 6. Bottom cassette 40*a* holds a waste container and the top cassette 40*b* holds supply containers. The bottom cassette is latched to the top cassette by latches 46*a*, 46*b* and two other latches on the opposed side but not shown in the drawings. A cover 48 is latched to top cassette 40*b* by latches 50*a* through 50*d*. This cover provides access to the rigid container caps though cover openings 52*a* through 52*e*.

Figure 8:
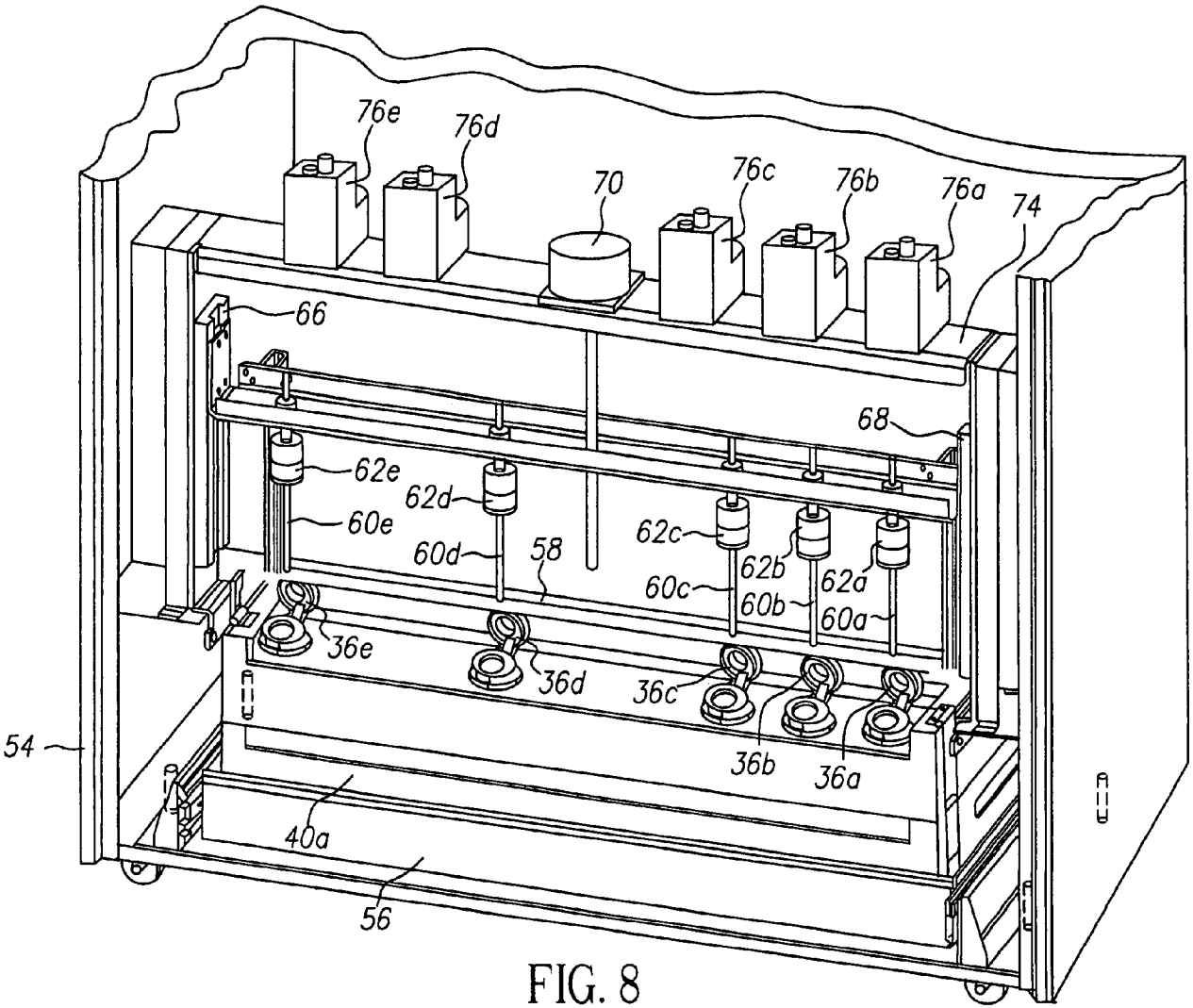
FIG. 8 is a rear perspective view of a machine according to the present invention showing the machine in a state partially through an opening stroke.
Figure 9:
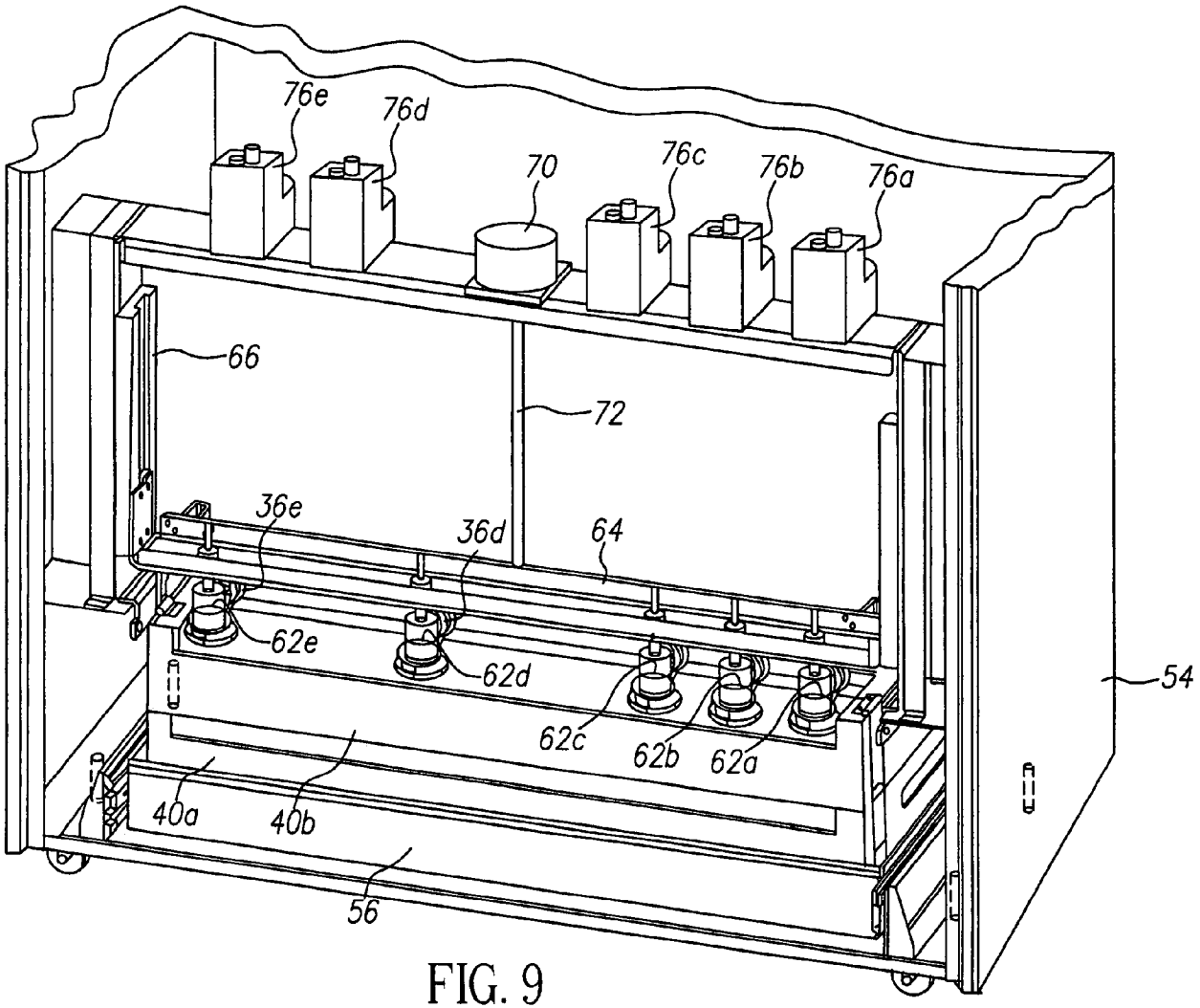
FIG. 9 is a rear perspective view similar to FIG. 8 in a different state of operation.
Figure 10:
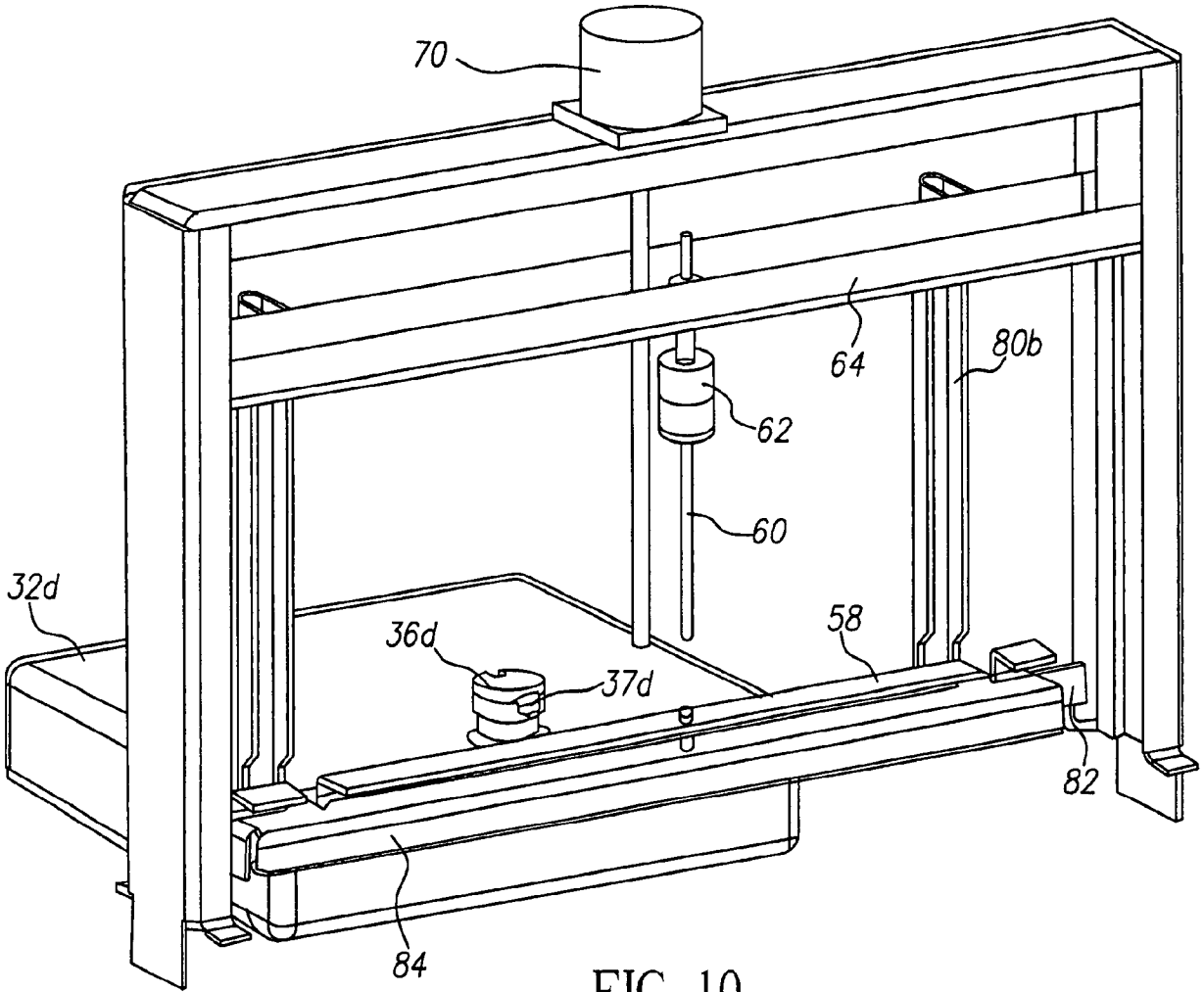
FIGS. 10–13 are schematic details of an illustrative embodiment of the machine showing the machine in progressive stages of operation.

FIGS. 8 and 9 are rear schematic views of a processing machine 54 in accordance with features of the present invention. A rear cover would ordinarily be provided, but has been omitted for clarity. In FIG. 8, a tray assembly 56 is shown with shipping and the chemical delivery cassettes 40*a* and 40*b* loaded therein. A cap opener bar 58 will be explained with reference to FIGS. 10–13.

A plurality of tubes 60*a*–60*e* descends from associated valves 62*a*–62*e*, which, in turn, are supported from an alignment bar 64. The alignment bar slides vertically along opposed rails 66 and 68 under the control of an electric drive motor 70 and a screw drive shaft 72. The drive motor is supported on a cross beam 74, which also supports a plurality of fluid pumps 76*a*–76*e*.

Figure 14:
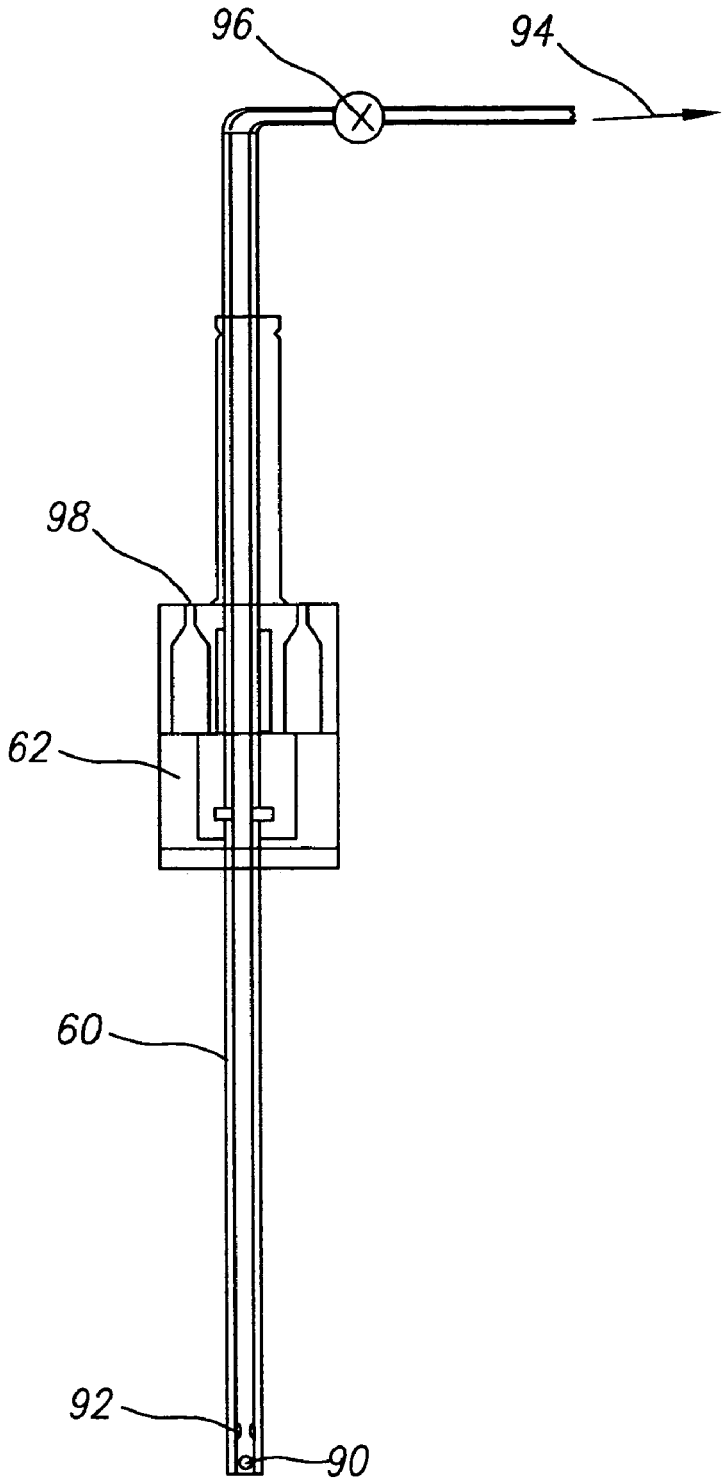
FIG. 14 is a detail view of a tube probe.

In FIG. 8, the machine-container interface is illustrated in a state partially through its opening sequence. Tray assembly 56 is in its operational position showing caps 36*a* through 36*e* opened. Each cap is attached to a rigid container as shown in FIG. 8. For illustration purposes, each cap opens a separate rigid container. As illustrated, caps 36*a* through 36*e* have been simultaneously opened using simultaneous cap opening bar 58. Tubes 60*a* through 60*e* are not yet inserted into the opened caps. Valves 62*a* through 62*e*, each one associated with one tube, are used to close the rigid container when in use and provide a port for air to equilibrate pressure when solution is removed from the rigid containers, as shown in FIG. 14. The processing machine in FIG. 8 uses drive motor 70 to drive a screw drive shaft 72. The screw drive shaft is attached to alignment bar 64 such that actuation of drive motor 70 causes screw drive shaft 72 to turn; thereby raising and lowering alignment bar 64 along alignment rails 66 and 68. FIG. 9 illustrates the mechanism state with alignment bar 64 lowered.

FIGS. 10–13 are simplified schematics intended to more clearly illustrate how the action of raising and lowering alignment bar 64 pivots cap opener bar 58 to open caps 36*a* through 36*e*. Actuating bars 80*a* and 80*b* are attached to alignment bar 64 to open caps 36*a* through 36*e*.

Drive motor 70 is attached to screw drive shaft 72, which raises and lowers alignment bar 64 and simultaneously raises and lowers valve 62 and tube 60. Also attached to alignment bar 64 are mechanical actuating bars 80*a* and 80*b* used to open cap 36*d* by causing simultaneous cap opener bar 58 to rotate around a pivot point 82 when the alignment bar is raised or lowered. Simultaneous cap opener bar 58 has a turned edge 84 that engages tab 37*d* on cap 36*d*.

Figure 11:
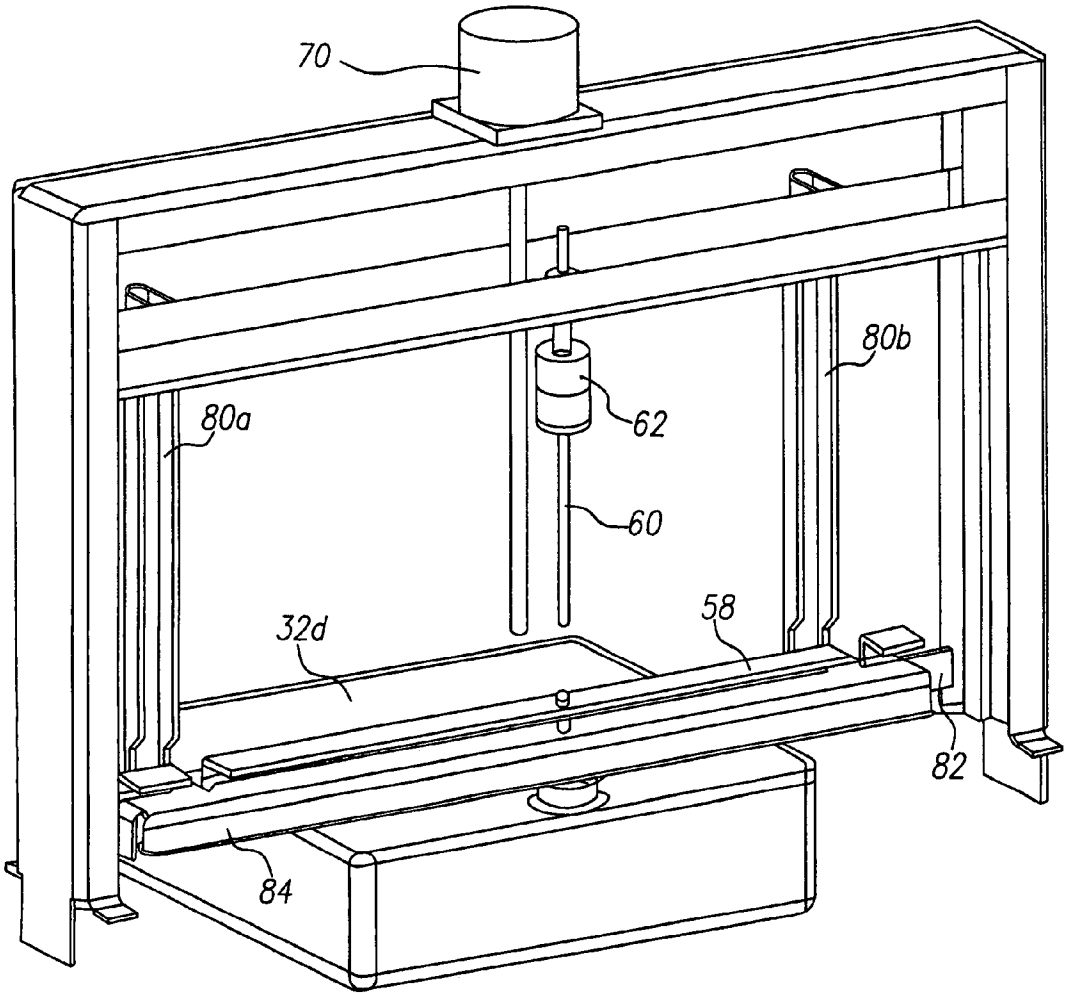
Figure 12:
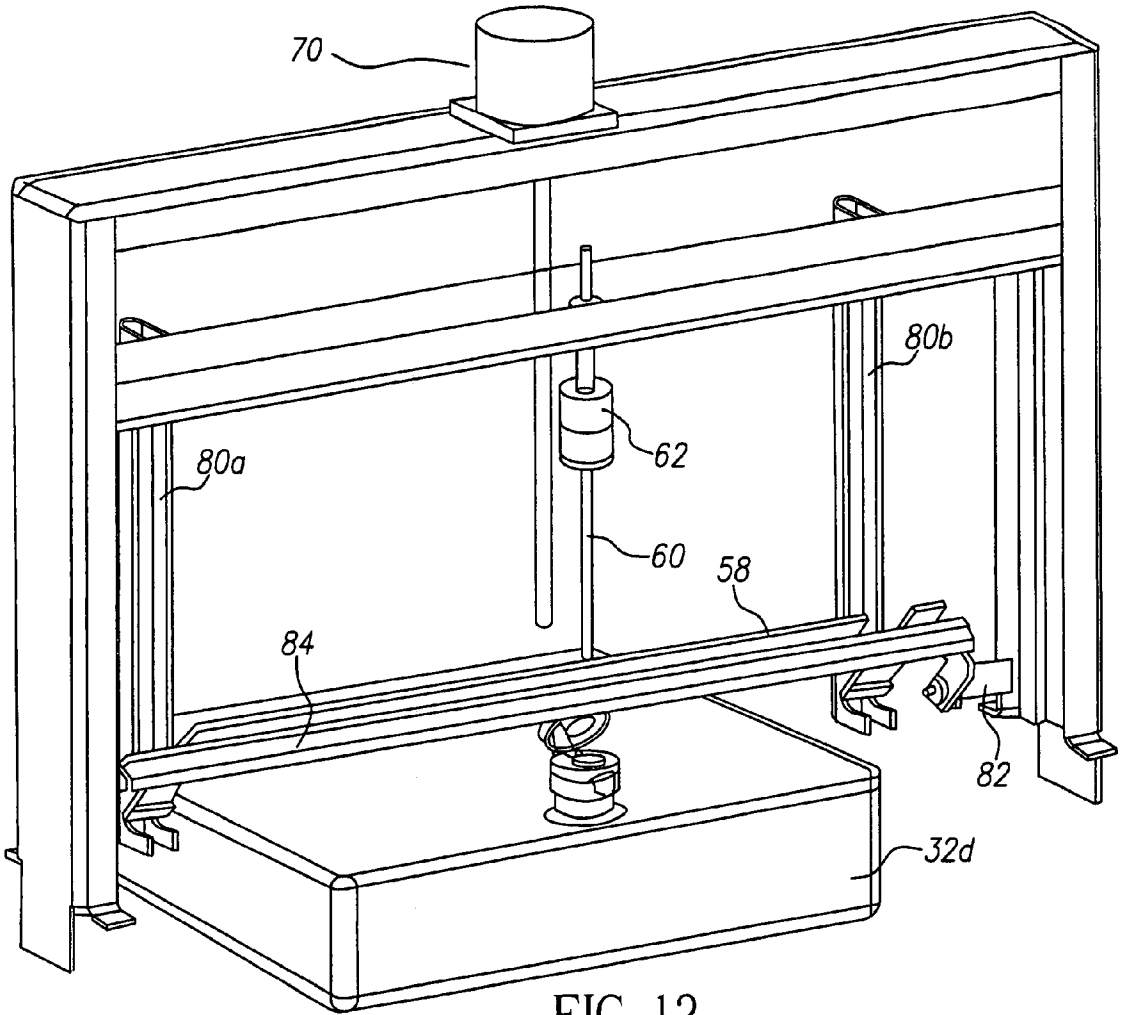

As simultaneous cap opener bar 58 pivots in a counter clockwise direction around pivot point 82, caused by the downward movement of actuating bars 80*a* and 80*b*, caps 36 on each of the containers are opened. The progress of these steps is illustrated schematically in FIGS. 10–13. FIG. 11 illustrates the rigid container fully seated so that tab 37 (not shown in FIG. 11) is engaged with turned edge 84 of simultaneous cap opener bar 58. FIG. 12 is like FIG. 11 except that drive motor 70 has started to turn screw drive shaft 72, thereby lowering alignment bar 64 and the attached mechanical actuating bars 80*a* and 80*b*. This motion causes simultaneous cap opener bar 58 to pivot counter clockwise around pivot point 82 and cause turned edge 84 to lift and, in so doing, open cap 36.

Figure 13:
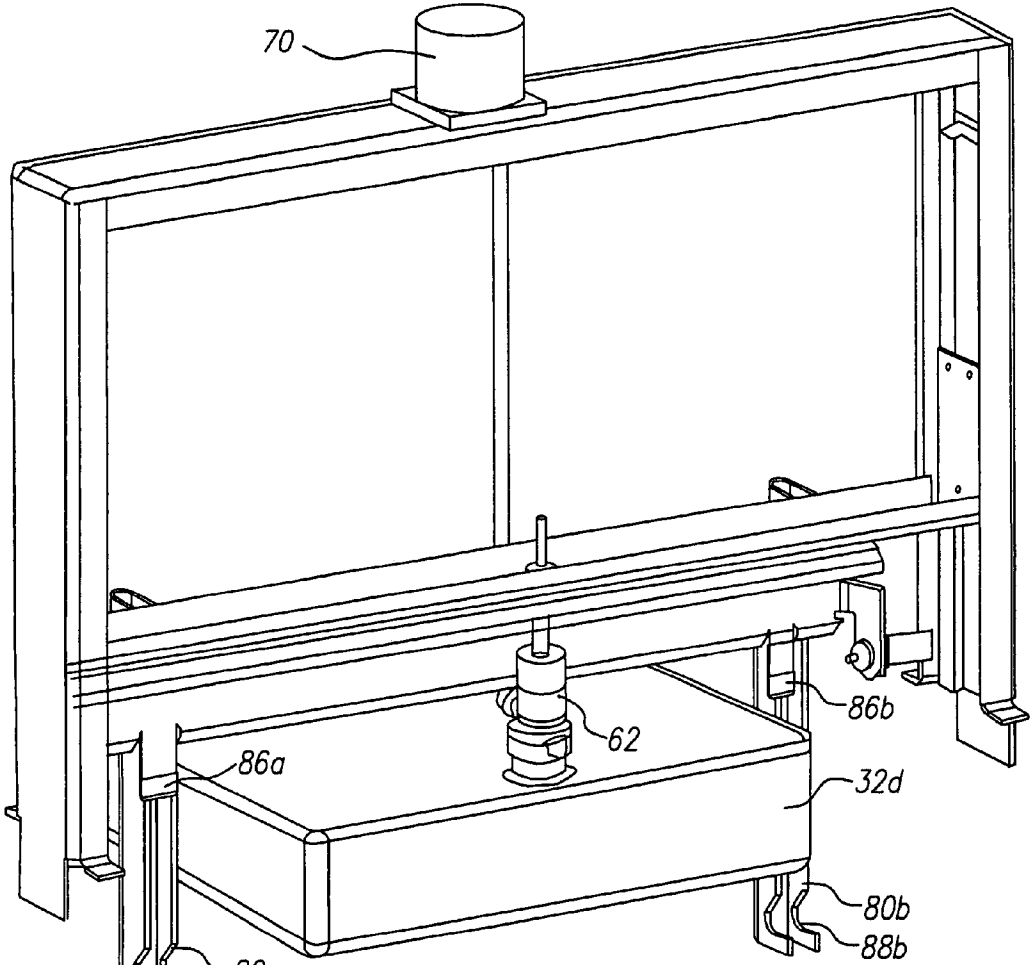

In FIG. 13, valve 62 is fully seated in the completely opened rigid container. Actuating bars 80*a* and 80*b* are in their fully lowered position, revealing tabs 86*a* and 86*b* on simultaneous cap opener bar 58. When the process reverses, tabs 86*a* and 86*b* engage notches 88*a* and 88*b* on actuating bars 80*a* and 80*b*, respectively. One rigid container was shown for illustrative clarity. It should be clear that multiple caps 36*a* through 36*e* with associated tabs 37*a* through 37*e* (not shown) can be opened in this single stroke mechanical device as long as the caps and tabs are aligned to engage turned edge 84 of simultaneous cap opener bar 58.

FIG. 14 is a schematic of the assembly of tube 60 and valve 62. One example of the tip of the tube is the side ported tube in which the tube is a closed-ended tube with an entrance hole 90 drilled in the side of it through which solution flows when one of pumps 76 starts to pump. Near the tip of tube 60 is a conductivity sensor 92 used to insure liquid solution connectivity between the contents of the rigid supply container and the processing machine. For example, when air is drawn into tube 60 indicating the attached rigid container is empty, the air bubble causes a drop in conductivity. Interfaced with a computer, this signal causes an associated pump 76 to stop pumping. The solution flow 94 halts. No more solution draw causes check valve 96 to cap the solution head in tube 60. The solution still contained in the tube is then held in check while the machine-container interface starts the process of tube removal from the containers. It is clear to those knowledgeable in the art that a conductivity sensor is not needed in the tip of the tube filling the waste container. Since the supply and waste containers are simultaneously removed from the machine when the machine needs to be recharged with chemical supplies, there is no need to include a filled sensor on this tube.

A rigid container cannot be pumped empty without allowing for pressure equilibration. Valve 62 is fitted with venting ports 98 to allow for pressure equilibration when the valve is fully engaged with the rigid supply and waste containers.

Figure 15:
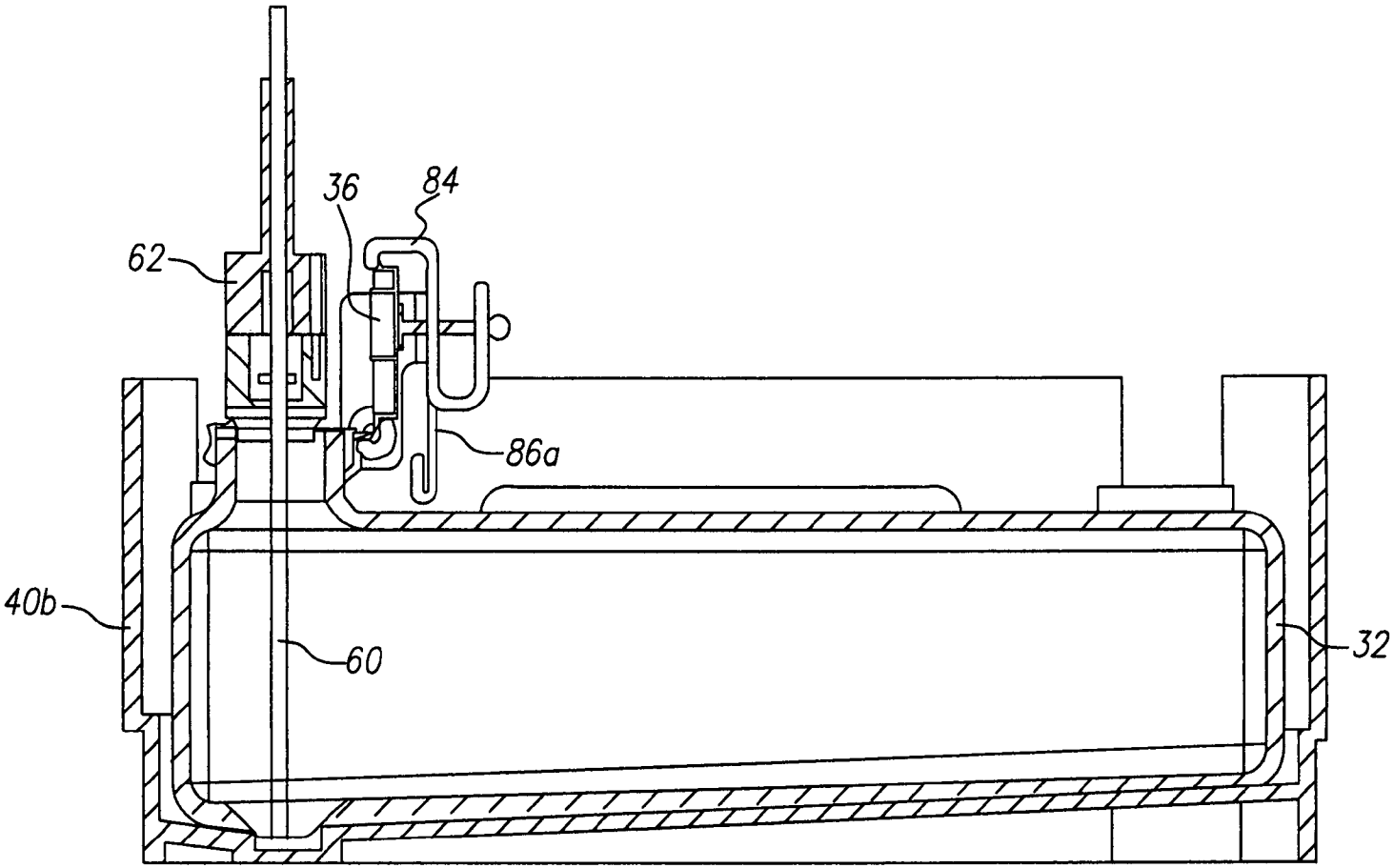
FIG. 15 is a sectional view of an open supply container with a tube probe of FIG. 13 inserted.

FIG. 15 is a sectional view of an open supply container with a tube probe of FIG. 13 inserted.

The invention has been described in detail with particular reference to certain preferred embodiments thereof, but it will be understood that variations and modifications can be effected within the spirit and scope of the invention.

PARTS LIST

| | |
|---|---|
| 10 | Waste Container |
| 12 | Tapered recess |
| 14 | Port |
| 16 | Cap |
| 18 | Tab |
| 20 | Drain |
| 22 | Supply container |
| 24 | Port |
| 26 | Caps |
| 28 | Bottom wall |
| 32a–32d | Rigid supply containers |
| 34 | Rigid contoured waste container |
| 35 | Waste Solution receiving port |
| 36a–36e | Caps |
| 37a–37e | Tabs on caps |
| 38 | Waste container drains |
| 40 | Shipping and chemical delivery cassette |
| 40a | Bottom cassette |
| 40b | Top cassette |
| 42 | Bottom |
| 44 | Ribs |
| 46a–46b | Snapped interlocks |
| 48 | Integrated shipping and chemical delivery cassette cover |
| 50a–50d | Latches |
| 52a–52e | Openings |
| 54 | Processing machine |
| 56 | Tray assembly |
| 58 | Simultaneous Cap opener bar |
| 60a–60e | Tubes |
| 62a–62e | Valves |
| 64 | Alignment Bar |
| 66 and 68 | Alignment rails |
| 70 | Drive motor |
| 72 | Screw drive shaft |
| 74 | Cross Beam |
| 76a–76e | Fluid pump |
| 80a and 80b | Actuating Bars |
| 82 | Pivot point for simultaneous cap opener |
| 84 | Turned edge |
| 86a and 86b | Tabs |
| 88a and 88b | Notches |
| 90 | Side ported tube |
| 92 | Conductivity probe |
| 94 | Solution flow when processor is running |

-continued

| PARTS LIST | |
|---|---|
| 96 | Check Valve |
| 98 | Venting air port of valve |

The invention claimed is:

1. A rigid waste container adapted to be received in a photographic processing machine along with a chemical supply container, said waste container comprising:

a wall structure enclosing a volume, said wall structure including a major top surface adapted to receive at least one chemical supply container and formed at an angle to horizontal when the waste container is received in the processing machine wherein a surface of a received chemical supply container engaging said major top surface of said waste container is oriented at an angle to horizontal; and a port into the volume through which waste chemical is receivable from the process machine.

2. A rigid waste container as set forth in claim 1, wherein the major top surface of the waste container is a depression in the wall structure.

3. A rigid waste container as set forth in claim 1, wherein the major top surface of the waste container is a plurality of depressions in the wall structure, each depression being adapted to receive a respective chemical supply container.

4. A rigid waste container as set forth in claim 1, wherein the port comprises a necked region and an associated cap.

5. A rigid waste container as set forth in claim 4, wherein the associated cap is snap fitted to the necked region.

6. A rigid waste container as set forth in claim 4, wherein the port is necked and oriented such that the neck extends vertically when the waste container is received in the processing machine.

7. A rigid container assembly for use with a photographic processing machine; said container assembly comprising:

a rigid waste container adapted to be received in the processing machine at a predetermined orientation and further having a major top surface formed at an angle to horizontal when the waste container is received in the processing machine; and at least one rigid supply container for chemical delivery to the processing machine, said supply container having:

a bottom wall that forms a bottom surface of a fluid chamber in the container, the bottom wall fitting the top surface of the waste container such that the bottom surface of the fluid chamber is tipped so that fluid contents in the chamber flows to a low side of the chamber, and a fluid supply port, said port being located in a top wall of the supply container above the low side.

8. A rigid container assembly as set forth in claim 7, wherein the major top surface of the waste container is a depression.

9. A rigid container assembly as set forth in claim 7, wherein the waste container further comprises a necked fluid waste receiving port and associated cap.

10. A rigid container assembly as set forth in claim 7, wherein the waste container further comprises a waste drain.

11. A rigid container assembly as set forth in claim 7, wherein the fluid supply port is necked and oriented such that the neck extends vertically when the waste container and the supply container are received in the processing machine.

12. A rigid container assembly as set forth in claim 7, wherein the fluid supply port has an associated cap.

13. A shipping and chemical delivery cassette for a container of photographic processing chemical, said cassette comprising:

a plurality of vertical walls that substantially laterally surround an interior volume;

a bottom wall sloping from first side of the cassette toward a second side of the cassette, said first and second sides being opposed to each other; and a plurality of ribs extending upwardly from the bottom wall and terminating in a common horizontal plane so as to form a plurality of open topped cavities between the ribs.

14. A shipping and chemical delivery cassette as set forth in claim 13 wherein said cassette is adapted to selectively receive:

a single container conforming approximately to the interior volume surrounded by the vertical walls so as to rest on the ribs in the common horizontal plane; and a plurality of containers substantially smaller than the single container so as to fit between the upwardly extending ribs in the open topped cavities.

15. A shipping and chemical delivery cassette system for containers of photographic processing chemical, said cassette system comprising:

two stacked upper and lower delivery cassettes each having:

a plurality of vertical walls that substantially laterally surround an interior volume, a bottom wall sloping from first side of the cassette toward a second side of the cassette, said first and second sides being opposed to each other, and a plurality of ribs extending upwardly from the bottom wall and terminating in a common horizontal plane so as to form a plurality of open-topped cavities between the ribs;

a single container in the lower cassette and conforming approximately to the interior volume surrounded by the vertical walls so as to rest on the ribs in the common horizontal plane; and a plurality of containers in the upper cassette and substantially smaller than the single container so as to fit between respective upwardly extending ribs into the open-topped cavities.

16. A photographic processing machine, said processing machine comprising:

a housing adapted to receive a chemical delivery container assembly having a plurality of aligned fluid supply ports with associated caps having aligned hinges along one side of the caps;

a cap opening bar;

a mounting mechanism with a pivot point aligning the cap opening bar with the caps of a received chemical delivery container assembly along a side of the caps opposite to the one side along which the hinges are aligned such that rotation of the cap opening bar about the pivot point simultaneously opens the fluid supply ports by rotating the caps about their hinges.

17. A photographic processing machine as set forth in claim 16 wherein the caps have tabs along the side of the caps opposite to the one side along which the hinges are aligned, said mounting mechanism aligning the cap opening bar under the tabs of a received chemical delivery container assembly.

18. A photographic processing machine as set forth in claim 16 further comprising a plurality of fluid transfer tubes lowerable into the fluid supply ports of a received chemical delivery container assembly when the caps are opened by said cap opening bar.

19. A photographic processing machine as set forth in claim 16 further comprising:

a plurality of fluid transfer tubes lowerable into the fluid supply ports of a received chemical delivery container assembly when the caps are opened by said cap opening bar; and an interface between the fluid transfer tubes and the cap opening bar, said interface sequencing the cap opening bar to move about the pivot point to simultaneously open the fluid supply ports as the fluid transfer tubes are being lowed to approach the fluid supply ports.

20. A method for providing for chemical delivery to and from a photographic processing machine comprising the steps of:

providing a rigid waste container to a photographic processing machine, said waste container having:

a wall structure enclosing a volume, said wall structure including a major top surface adapted formed at an angle to horizontal when the waste container is received in the processing machine, and a port into the volume, through which waste chemical is receivable from the process machine; and providing at least one chemical supply container in the waste container such that the at least one chemical supply container is received by the major top surface, wherein a surface of a received chemical supply container engaging said major top surface of said waste container is oriented at an angle to horizontal.

21. A method for providing for chemical delivery to and from a photographic processing machine comprising the steps of:

providing a rigid waste container adapted to be received in the processing machine at a predetermined orientation and further having a major top surface formed at an angle to horizontal when the waste container is received in the processing machine; and providing at least one rigid supply container for chemical delivery to the processing machine, said supply container having:

a bottom wall that forms a bottom surface of a fluid chamber in the container, the bottom wall fitting the top surface of the waste container such that the bottom surface of the fluid chamber is tipped so that fluid contents in the chamber flows to a low side of the chamber, and a fluid supply port, said port being located in a top wall of the supply container above the low side.

22. A method for providing for chemical delivery to and from a photographic processing machine comprising the steps of:

providing a housing adapted to receive a chemical delivery container assembly having a plurality of aligned fluid supply ports with associated caps having aligned hinges along one side of the caps;

providing a cap opening bar;

providing a mounting mechanism with a pivot point aligning the cap opening bar with the caps of a received chemical delivery container assembly along a side of the caps opposite to the one side along which the hinges are aligned such that rotation of the cap opening bar about the pivot point simultaneously opens the fluid supply ports by rotating the caps about their hinges.

* * * * *